US007292120B2

(12) United States Patent
Yoneda

(10) Patent No.: US 7,292,120 B2
(45) Date of Patent: Nov. 6, 2007

(54) NONRECIPROCAL CIRCUIT DEVICE AND COMMUNICATION DEVICE

(75) Inventor: Shinichi Yoneda, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 594 days.

(21) Appl. No.: 10/706,045

(22) Filed: Nov. 13, 2003

(65) Prior Publication Data

US 2004/0113710 A1 Jun. 17, 2004

(30) Foreign Application Priority Data

Dec. 12, 2002 (JP) ..... 2002-361137
Sep. 25, 2003 (JP) ..... 2003-334003

(51) Int. Cl.
*H01P 1/32* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | | |
|---|---|---|---|---|
| 3,831,114 | A | 8/1974 | Paglione | |
| 4,904,965 | A | 2/1990 | Blight et al. | |
| 5,858,145 | A * | 1/1999 | Sreeram et al. | 156/89.16 |
| 2002/0079981 | A1 | 6/2002 | Tanaka | |

FOREIGN PATENT DOCUMENTS

| | | |
|---|---|---|
| DE | 1 591 268 | 10/1970 |
| JP | 09-055607 A | 2/1997 |
| JP | 2002-76711 | 3/2002 |
| JP | 2002-270465 A | 9/2002 |

OTHER PUBLICATIONS

Official Communication issued on Aug. 26, 2005, by the Patent Office of the State Intellectual Property Office of the People's Republic of China in the corresponding Chinese Application No. 200310122593.0 filed on Dec. 12, 2003.

Official Communication issued in corresponding Japanese Patent Application No. 2003-334003, dated Jun. 26, 2006.

* cited by examiner

*Primary Examiner*—Stephen E. Jones
(74) *Attorney, Agent, or Firm*—Keating & Bennett, LLP

(57) ABSTRACT

A nonreciprocal circuit device and a communication device having a nonreciprocal circuit device in which each end portion of each center electrode in the bottom layer of a multilayer-electrode structure on a surface of ferrite is thickened by forming a filled-in electrode in an opening in first and second insulating films on the upper surface of the end portion of the center electrode in the bottom layer. Each end portion of each center electrode in the second layer is thickened by forming a filled-in electrode in an opening in the second insulating film on the upper surface of the end portion of the center electrode in the second layer. Each end portion of each center electrode in the top layer (third layer) is thickened by forming a filled-in electrode in an opening in the second insulating film on the lower surface of the end portion of the center electrode in the top layer.

9 Claims, 13 Drawing Sheets

NONRECIPROCAL CIRCUIT DEVICE AND COMMUNICATION DEVICE

BACKGROUND OF THE INVENTION

1. Field of the Invention

The present invention relates to a nonreciprocal circuit device, and more particularly, to a nonreciprocal circuit device, such as an isolator, for use in a microwave band and a communication device including such a nonreciprocal circuit device.

2. Description of the Related Art

In a mobile communication device such as a portable telephone, a nonreciprocal circuit device, such as an isolator or a circulator, is typically used to transmit a signal in only one direction without allowing the signal to pass in the opposite direction.

In general, such a nonreciprocal circuit device includes a permanent magnet, a center electrode assembly to which a fixed magnetic field is applied by the permanent magnet, and a metal case in which the permanent magnet and the center electrode assembly are disposed.

As shown in FIG. 12, Japanese Unexamined Patent Application Publication No. 2002-76711 discloses a center electrode assembly 201 including a block-shaped microwave ferrite 231, center electrodes 221 to 223, insulating films 226, side electrodes (through-hole electrodes) 224, and a ground electrode 225.

Three pairs of center electrodes 221 to 223 are disposed on a surface 231*a* (a pole surface) of the ferrite 231, and insulating films 226 are disposed between respective adjacent pairs of center electrodes. Both ends of each of the center electrodes 221 to 223 are each connected, in corners of the ferrite 231, with side electrodes 224 provided on side surfaces 231*c* of the ferrite 231. One end of each of the center electrodes 221 to 223 is electrically connected via a side electrode 224 to a ground electrode 225 disposed over substantially the entire lower surface 231*b*. The side electrodes connected to the other ends of the respective center electrodes 221 to 223 define ports P1, P2 and P3. The ports P1 to P3 are used to connect the center electrode assembly 201 to an external circuit. Each of the ports P1 to P3 is isolated from the ground electrode 225 by a gap 228.

The center electrodes 221 to 223 are formed of a conductive material, such as silver, by screen printing or other suitable methods. The side electrodes 224 are formed as follows. First, holes are formed through the ferrite 231 such that the holes extend from the upper surface to the lower surface of the ferrite 231. Conductive paste is then filled in the through-holes or a plated film is formed on the inner wall of each through-hole. Finally, each through-hole is cut at its center.

The insulating films 226 are formed of glass or other suitable material by screen printing or other suitable methods over almost the entire surface 231*a* of the ferrite 231 except for a peripheral area such that the center electrodes 221 to 223 crossing each other are isolated from each other by the insulating films 226. Because the insulating films 226 are provided merely to insulate the respective layers of the center electrodes 221-223 from each other, a large alignment tolerance is acceptable in patterning of the center electrodes 221-223. Thus, alignment accuracy obtained in usual screen printing techniques is sufficient.

However, in the center electrode assembly 201 disclosed in Japanese Unexamined Patent Application Publication No. 2002-76711, the center electrodes 221 to 223 provided on the surface 231*a* of the ferrite 231 have a small uniform thickness, and thus, as shown in a circle A in FIG. 13, the side electrodes 224 and the corresponding center electrodes 221-223 are connected with each other via a small contact area. This results in poor connection reliability.

To avoid the problem described above, it has been proposed to increase the thickness over the entire center electrodes 221 to 223 such that the center electrodes 221 to 223 can be connected with corresponding side electrodes 224 via an increased contact area. However, it is difficult to increase the thickness of the entire center electrodes 221 to 223 by screening printing. In addition, the increase in thickness over the entire center electrodes 221 to 223 results in an increase in the total thickness of the center electrode assembly 201, and thus it is impossible to satisfy the requirement for a reduction in thickness of the center electrode assembly 201.

SUMMARY OF THE INVENTION

To overcome the problems described above, preferred embodiments of the present invention provide a nonreciprocal circuit device having a greatly improved connection reliability between center electrodes and side electrodes without increasing the thickness thereof. Another preferred embodiment of the present invention provides a communication device which includes such a nonreciprocal circuit device.

A preferred embodiment of the present invention provides a nonreciprocal circuit device including a center electrode assembly including a ferrite, a plurality of center electrodes and a plurality of insulating films disposed in a multilayer structure on a surface of the ferrite, and a plurality of side electrodes provided on side surfaces of the ferrite, wherein each end portion of each center electrode provided on the surface of the ferrite has a thickness greater than the thickness of the other portion of each center electrode, and each thick end portion of each center electrode is connected to a corresponding side electrode.

Each thick end portion of each center electrode is preferably defined by a conductive material filled in corresponding openings (recessed portions) provided in peripheral portions of the insulating films. More specifically, the thickness of each end portion of the center electrode in the bottom layer of the multilayer structure on the surface of the ferrite is preferably increased by a conductive material filled in a corresponding opening (recessed portion) provided in the insulating films on the upper surface of the end portion. The thickness of each end portion of the center electrode in the top layer of the multilayer structure on the surface of the ferrite is preferably increased by a conductive material filled in a corresponding opening (recessed portion) provided in the insulating films on the lower surface of the end portion. Preferably, the center electrodes are formed of a photosensitive conducting material and the insulating films are formed of a photosensitive insulating material.

In the structure according to preferred embodiments of the present invention, each center electrode is connected with a corresponding side electrode via a thickened end portion of the center electrode so as to increase the contact area therebetween. On the other hand, the thickness of the other portions of each center electrode other than the end portions is not increased. Because the thickness of the end portions of the center electrodes in the top layer is increased downwardly, no increase occurs in the total thickness of the center electrode assembly.

Another preferred embodiment of the present invention provides a communication device including a nonreciprocal circuit device having the above-described features, and thus, having an improved connection reliability and a decreased thickness.

In preferred embodiments of the present invention, as described above, connections between center electrodes and the corresponding side electrodes are achieved via thickened end portions of the center electrodes such that the connections have increased contact areas. On the other hand, the thickness of the other portions of each center electrode other than the end portions is not increased. Because the thickness of the end portions of the center electrodes in the top layer is increased downwardly, no increase occurs in the total thickness of the center electrode assembly. Thus, the nonreciprocal circuit device and the communication device according to preferred embodiments of the present invention have a greatly improved connection reliability without increasing the total thickness thereof.

The above and other elements, characteristics, features, steps and advantages of the present invention will become clear from the following description of preferred embodiments taken in conjunction with the accompanying drawings.

DETAILED DESCRIPTION OF PREFERRED EMBODIMENTS

The present invention is described in further detail below with reference to preferred embodiments of a nonreciprocal circuit device and a communication device in conjunction with the accompanying drawings.

First Preferred Embodiment (FIGS. 1 to 10)

Figure 1:
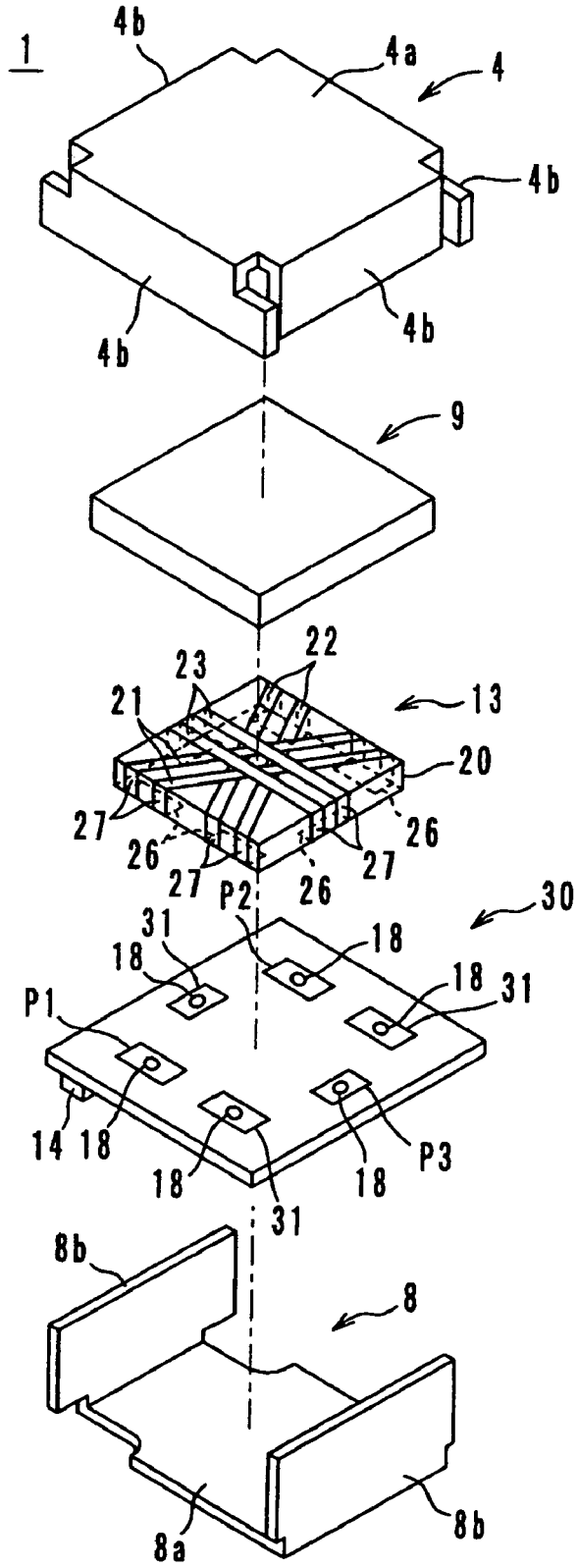
FIG. 1 is an exploded perspective view of a nonreciprocal circuit device according to a preferred embodiment of the present invention.

FIG. 1 is an exploded perspective view of a nonreciprocal circuit device according to a preferred embodiment of the present invention. In this specific preferred embodiment, the nonreciprocal circuit device 1 is preferably a lumped-constant isolator. As shown in FIG. 1, the lumped-constant isolator preferably includes a metal case including an upper metal case 4 and a lower metal case 8, a center electrode assembly 13 including a permanent magnet 9, ferrite 20 and center electrodes 21 to 23, and a multilayer substrate 30.

The upper metal case 4 has substantially a box shape including a top portion 4*a* and four side portions 4*b*. The lower metal case 8 includes a bottom portion 8*a* and right and left side portions 8*b*. To provide a magnetic circuit, the upper metal case 4 and the lower metal case 8 are preferably made of a ferromagnetic material such as soft iron, and the surfaces thereof are plated with silver, copper, or other suitable material.

The center electrode assembly 13 includes a microwave ferrite 20 having a substantially rectangular block shape and three sets of center electrodes 21 to 23 provided on the upper surface of the microwave ferrite 20 such that the center electrodes 21 to 23 cross each other at approximately 120° via the insulating layers (not shown in FIG. 1). In this first preferred embodiment, each of the center electrode sets 21 to 23 includes two lines of electrodes.

Figure 2:
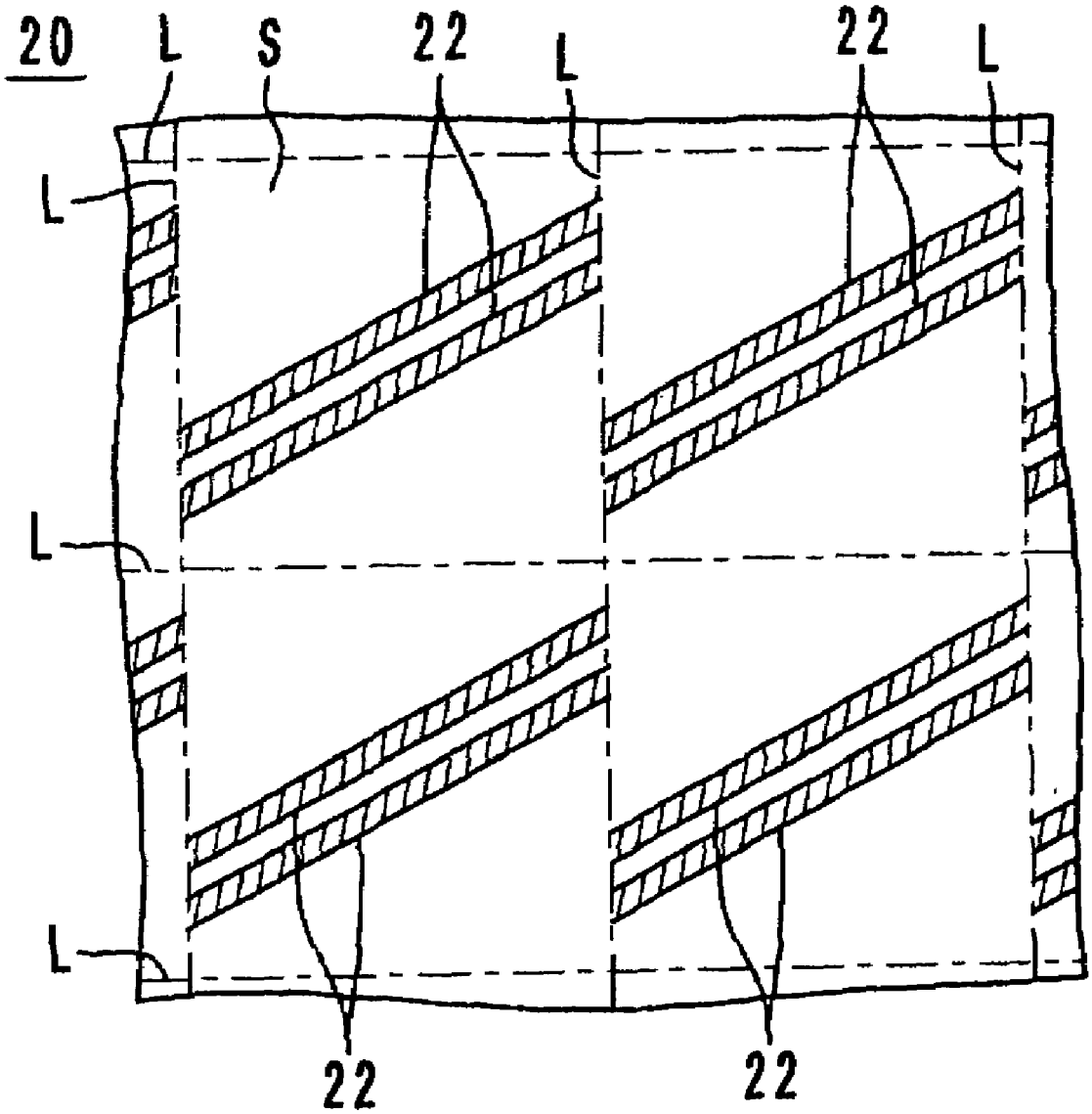
FIG. 2 is a plan view showing an example of a process of producing the center electrodes shown in FIG. 1.

For example, the center electrode assembly 13 may be produced as follows. First, as shown in FIG. 2, a pattern of a set of center electrodes 22 is formed in each unit area S of the upper surface of a ferrite mother substrate 20 with a size of approximately 4×4 inches by printing a photosensitive thick film. Note that the ferrite mother substrate 20 will be divided into individual center electrode assemblies in areas S (having a typical size of 1 to 3 mm) by cutting it along cutting lines represented by long and short dashed lines L shown in FIG. 2.

In the photosensitive thick film printing, photosensitive conducting paste is uniformly coated to a particular thickness over substantially the entire surface of the ferrite mother substrate 20 by screen printing or another suitable method. The photosensitive conducting film is then illuminated (exposed) with an ultraviolet ray via a photomask pattern. Thereafter, the photosensitive conducting film is exposed by spraying a weak alkaline solution such that non-exposed portions of the photosensitive conducting film are etched (developed) to thereby form center electrodes 22. The center electrodes 22 are then baked so as to obtain final center electrodes 22 with a thickness of about 10 μm (typical value).

Figure 3:
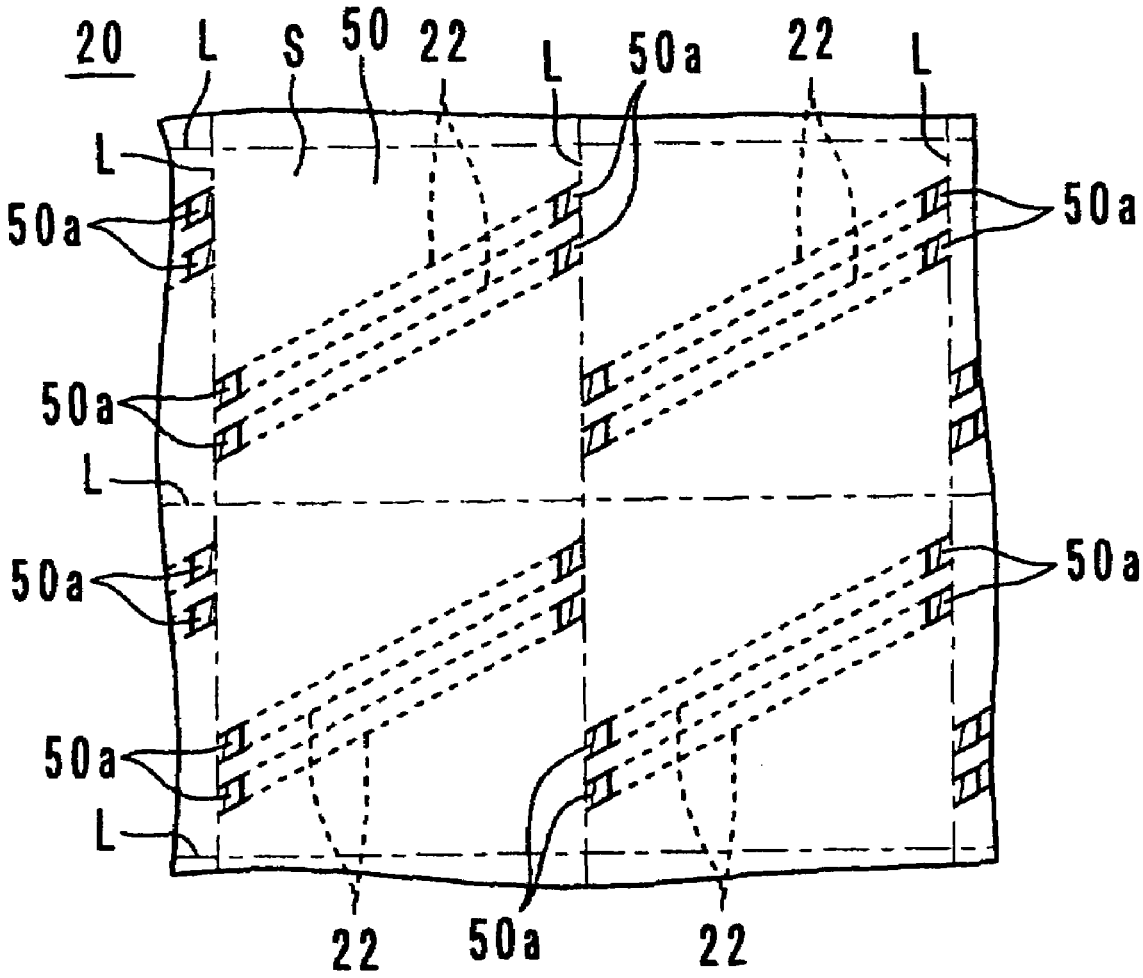
FIG. 3 is a plan view showing a process following that shown in FIG. 2.
Figure 4:
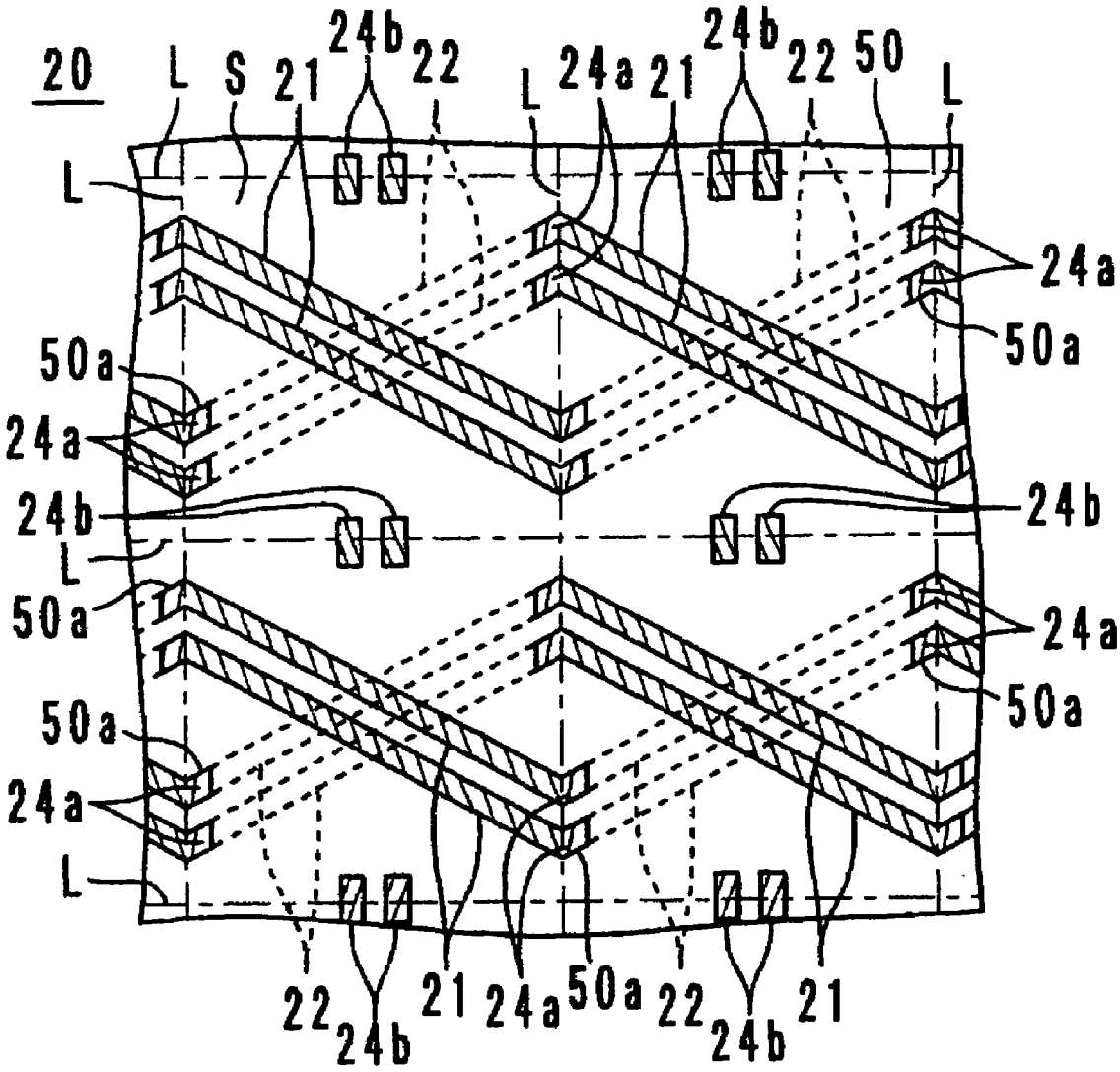
FIG. 4 is a plan view showing a process following that shown in FIG. 3.

Thereafter, using screen printing or another suitable method, photosensitive insulating paste is coated over substantially the entire surface of the ferrite mother substrate 20 such that the center electrodes 22 are covered with the photosensitive insulating paste, and the photosensitive insulating paste is dried. The photosensitive insulating film is then illuminated (exposed) with an ultraviolet ray via a photomask pattern. Thereafter, the photosensitive insulating film is exposed by spraying weak alkaline solution so that non-exposed portions of the photosensitive insulating film are etched (developed) thereby forming an insulating film 50 having openings (recessed portions) 50*a* as shown in FIG. 3. The insulating film 50 is then baked so as to obtain a final insulating film 50 with a thickness of about 20 μm (typical value). Each end of each of the center electrodes 22 is exposed in one of the openings (recessed portions) 50*a*.

Thereafter, photosensitive conducting paste is uniformly coated to a particular thickness over substantially the entire surface of the ferrite mother substrate 20, and the photosensitive conducting paste is dried. In this coating process, each opening (recessed portion) 50*a* is completely filled with photosensitive conducting paste. The photosensitive conducting film is then illuminated (exposed) with an ultraviolet ray via a photomask pattern. Thereafter, the photosensitive conducting film is exposed by spraying a weak alkaline solution such that non-exposed portions of the photosensitive conducting film are etched (developed) to thereby simultaneously form center electrodes 21 and filled-in electrodes 24*a* and 24*b*. In this process, the filled-in electrodes 24*a* are formed in the respective openings (recessed portions) 50*a* where end portions of center electrodes 22 are located, and the filled-in electrodes 24*b* are formed on the insulating film 50 at locations where end portions of the center electrodes 23 are located.

The center electrodes 21 and the filled-in electrodes 24*a* and 24*b* are baked thereby obtaining final forms of the center electrodes 21 and the filled-in electrodes 24*b* both having a thickness of about 10 μm (typical value) and the filled-in electrodes 24*a* having a thickness of about 30 μm. The center electrodes 21 and the filled-in electrodes 24*b* are formed on the surface of the insulating film 50, and the filled-in electrodes 24*a* are formed on the top of the respective center electrodes 22 exposed in the openings (recessed portions) 50*a*. Note that the center electrodes 21 and the filled-in electrodes 24*a* and 24*b* are formed such that top surfaces thereof are at a substantially equal height.

Figure 5:
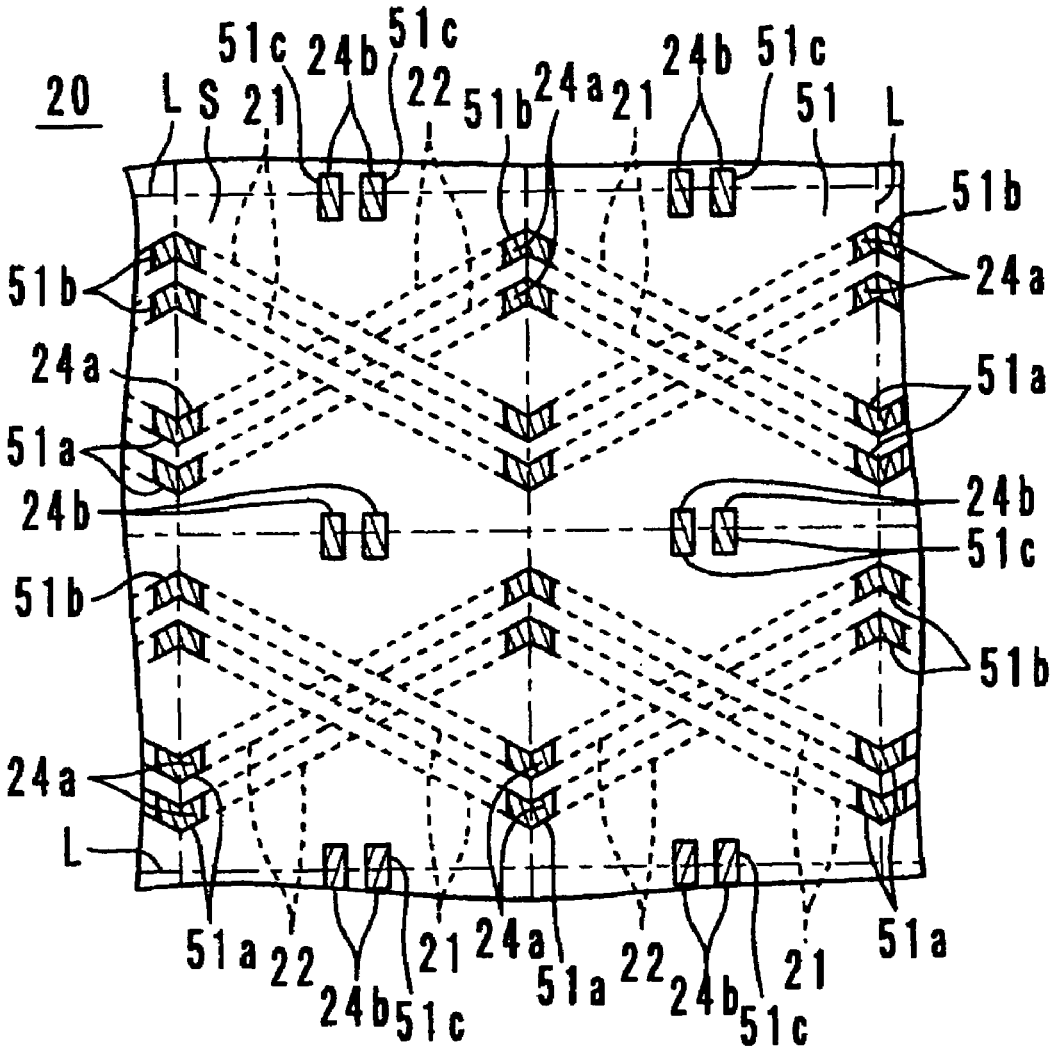
FIG. 5 is a plan view showing a process following that shown in FIG. 4.
Figure 6:
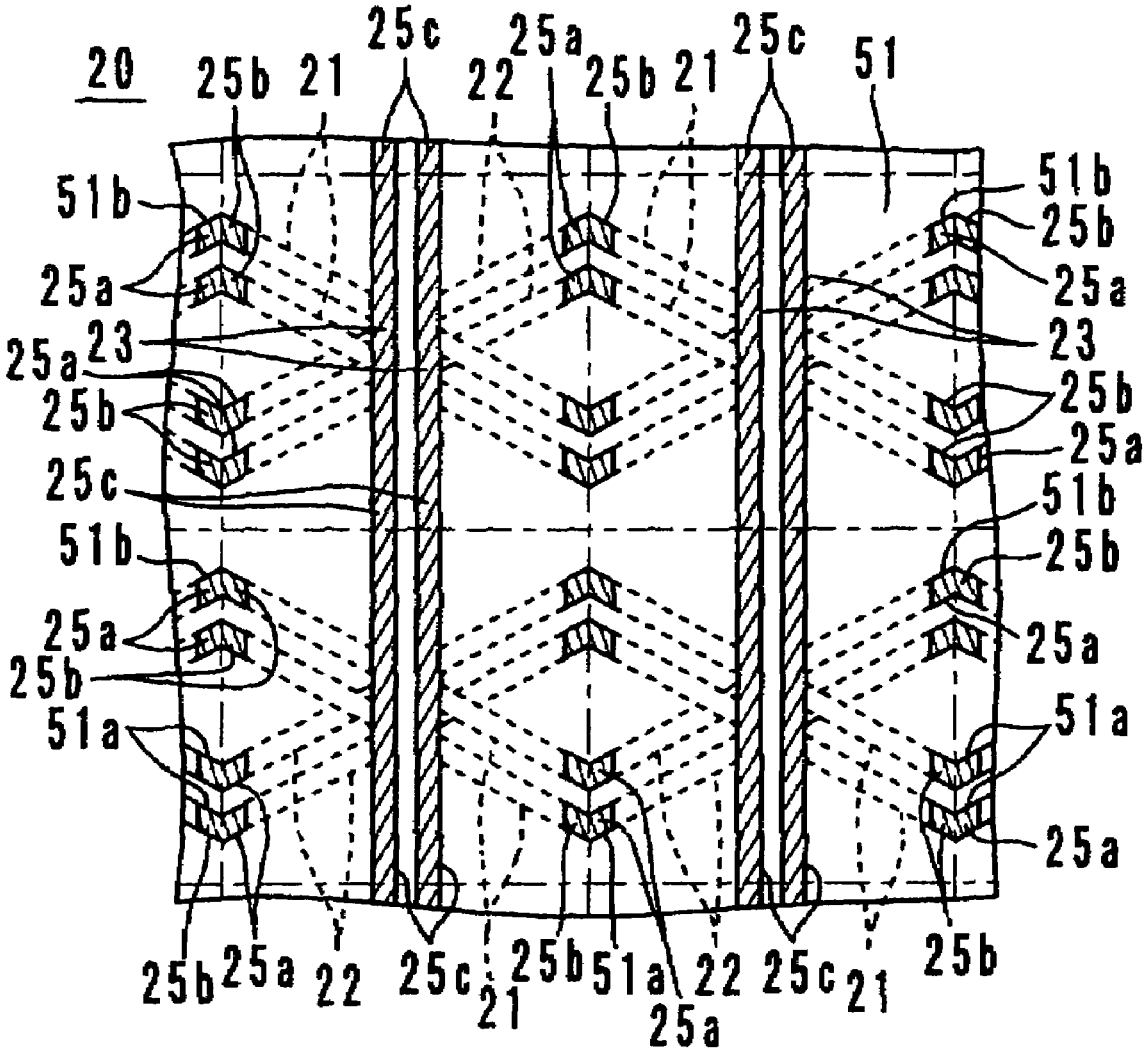
FIG. 6 is a plan view showing a process following that shown in FIG. 5.

Thereafter, using screen printing or other suitable process, photosensitive insulating paste is coated over the substantially entire surface of the ferrite mother substrate 20 such that the center electrodes 21 and the filled-in electrodes 24*a* and 24*b* are covered with the photosensitive insulating paste, and the photosensitive insulating paste is dried. The photosensitive insulating film is then illuminated (exposed) with an ultraviolet ray via a photomask pattern. Thereafter, the photosensitive insulating film is exposed by spraying a weak alkaline solution so that non-exposed portions of the photosensitive insulating film are etched (developed) thereby forming an insulating film 51 having openings (recessed portions) 51*a*, 51*b*, and 51*c*, as shown in FIG. 5. The insulating film 51 is then baked. Herein, one end of each center electrode 21 is exposed in a left-half portion of one of the openings (recessed portions) 51*a*, and one of the filled-in electrodes 24*a* is exposed in the right-half portion of that opening (recessed portions) 51*a*. And, one of the filled-in electrodes 24*a* is exposed in a left-half portion of each opening (recessed portion) 51*b*, and the other end of each center electrode 21 is exposed in the right-half portion of that opening (recessed portion) 51*b*. A filled-in electrode 24*b* is exposed in each opening (recessed portion) 51*c*.

Thereafter, photosensitive conducting paste is uniformly coated to a particular thickness over the substantially entire surface of the ferrite mother substrate 20, and the photosensitive conducting paste is dried. In this coating process, openings (recessed portions) 51*a*, 51*b* and 51*c* are completely filled with photosensitive conducting paste. The photosensitive conducting film is then illuminated (exposed) with an ultraviolet ray via a photomask pattern. Thereafter, the photosensitive conducting film is exposed by spraying a weak alkaline solution so that non-exposed portions of the photosensitive conducting film are etched (developed) to thereby simultaneously form center electrodes 23 and filled-in electrodes 25*a*, 25*b*, and 25*c*. In the process described above, each filled-in electrode 25*a* includes a right-half portion of an opening (recessed portion) 51*a* and in a left-half portion of an opening (recessed portion) 51*b*. That is, filled-in electrodes 25*a* are formed at locations where both ends of center electrodes 22 are disposed. On the other hand, each filled-in electrode 25*b* includes a left-half portion of an opening (recessed portion) 51*a* and in a right-half portion of an opening (recessed portion) 51*b*. That is, filled-in electrodes 25*b* are formed at locations where both ends of center electrodes 21 are disposed. Each filled-in electrode 25*c* is formed in one of the openings (recessed portions) 51*c*, where both ends of the center electrodes 23 are located.

The center electrodes 23 and the filled-in electrodes 25*a*, 25*b*, and 25*c* are baked to obtain the final center electrodes 23 having a thickness of about 20 μm (typical value), the filled-in electrodes 25*a* and 25*c* having a thickness of about 30 μm (typical value) and the filled-in electrodes 25*b* having a thickness of about 20 μm. The center electrodes 23 are formed on the surface of the insulating film 51, and the filled-in electrodes 25*a* are formed on the top of the respective filled-in electrodes 24*a* exposed in the right-halves of openings (recessed portions) 51*a* or in the left-halves of openings (recessed portions) 51*b*. The filled-in electrodes 25*b* are formed on the top of the respective center electrodes 21 exposed in the left-halves of openings (recessed portions) 51*a* or in the right-halves of openings (recessed portions) 51*b*, and the filled-in electrodes 25*c* are formed on the top of the respective filled-in electrodes 24*b* exposed in openings (recessed portions) 51*c*. Note that the center electrodes 23 and the filled-in electrodes 25*a* to 25*c* are formed such that top surfaces thereof are at approximately the same height.

In the above-described processing, the center electrodes 21 to 23, the filled-in electrodes 24*a*, 24*b*, 25*a*, 25*b*, and 25*c*, and the insulating films 50 are successively formed on top of each other. Folded electrodes 26 (FIG. 1) are then formed on the lower surface of the ferrite mother substrate 20 by screen printing, sputtering, evaporation, bonding, plating, or other suitable technique.

Figure 7:
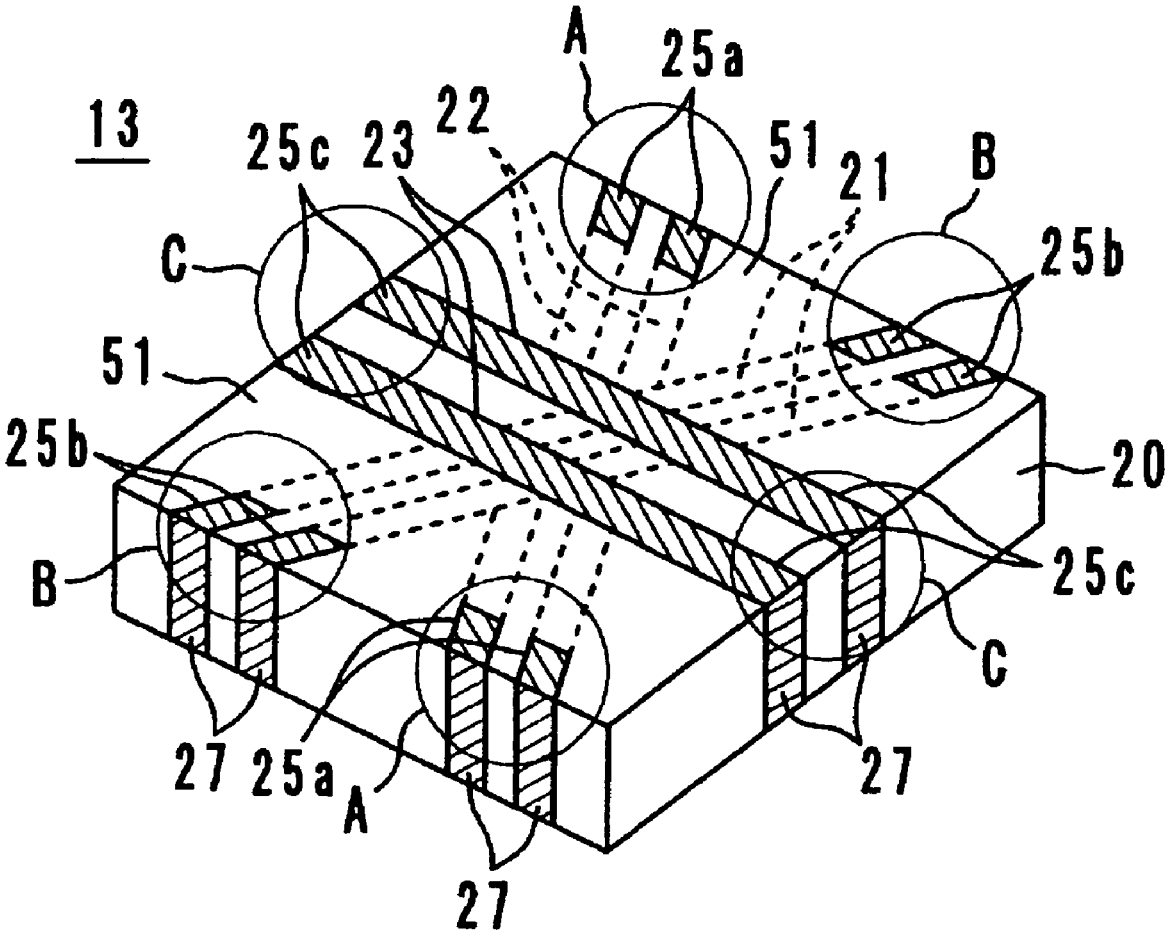
FIG. 7 is a plan view showing a process following that shown in FIG. 6.

Then the ferrite mother substrate 20 is cut along cutting lines represented by long and short dashed lines thereby dividing the ferrite mother substrate 20 into individual center electrode assemblies. The cutting may be performed, for example, using a laser or by dicing. After completion of the cutting, as shown in FIG. 7, side electrodes 27 are formed on the four side surfaces of each ferrite block 20 obtained via the cutting process. Thus, as described above, the present invention provides an excellent mass production method for the center electrode assembly 13.

In the center electrode assembly 13, the insulating films 50 and 51 are formed over substantially the entire surface of the ferrite 20 such that the center electrodes 21 to 23 are electrically insulated from each other. In a peripheral portion of the insulating films 50 and 51, openings (recessed portions) 50*a*, 51*b*, and 51*c* are formed at locations at which ends of respective center electrodes 21 to 23 are disposed. In the openings (recessed portions) 50*a*, 51*a*, 51*b*, and 51*c*, filled-in electrodes 24*a*, 24*b*, 25*a*, or 25*c* are formed. Using those filled-in electrodes 24*a*, 24*b*, 25*a*, 25*b*, and 25*c*, the thicknesses of both ends of each of center electrodes 21 to 23, which are connected to the corresponding side electrodes 27, are increased relative to the thicknesses of the other portions of the center electrodes 21 to 23.

Figure 8A:
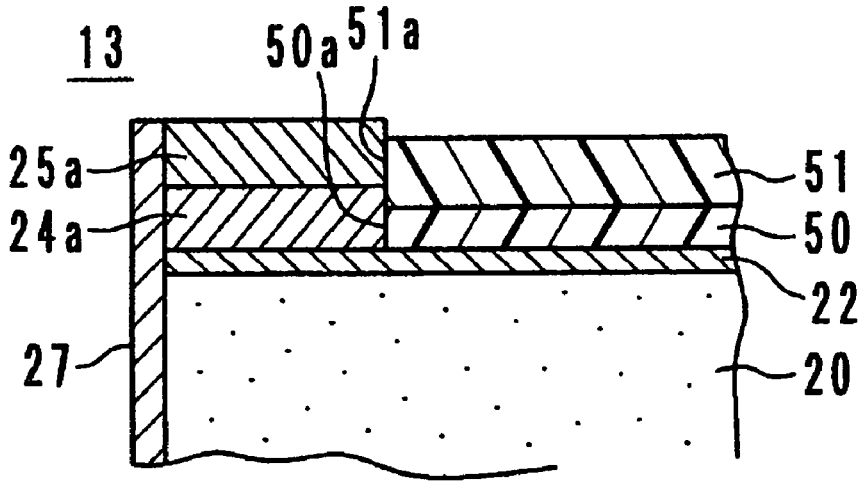
FIGS. 8A, 8B, and 8C are vertical cross-section views showing connections between an end portion of a center electrode and a side electrode.

More specifically, both end portions (for example, in areas represented by circles A in FIG. 7) of center electrodes 22 in the bottom layer of the multilayer structure on the upper surface of the ferrite 20 are thickened by forming the filled-in electrodes 24*a* and 25*a* in the openings (recessed portions) 50*a* and 51*a* in the respective insulating films 50 and 51 on the upper surface of the end portions of the center electrodes 22 in the bottom layer, as shown in FIG. 8A. That is, at both ends of the center electrodes 22, the thickness is increased upwardly to about 70 μm (typical value), which is greater than the thickness of about 10 μm (typical value) of the other portions of the center electrodes 22. As a result, the center electrodes 22 are electrically connected with corresponding side electrodes 27 via a contact area that is at least 3 times greater than that according to the conventional technique.

Figure 8B:
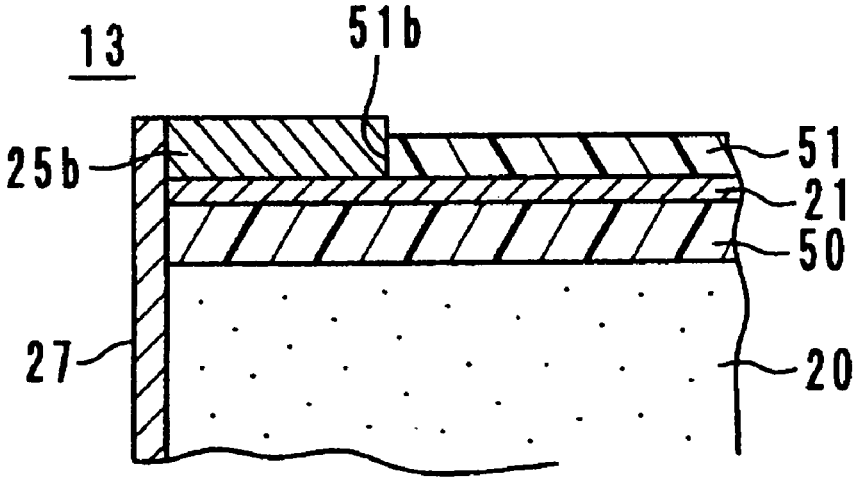

Similarly, the both end portions (in areas represented by circles B in FIG. 7) of the center electrodes 21 in the second layer are thickened by forming the filled-in electrodes 25*b* in the openings (recessed portions) 51*b* in the insulating film 51 on the upper surface of the end portions of the center electrodes 21 in the second layer, as shown in FIG. 8B. That is, at both ends of the center electrodes 21, the thickness is increased upwardly to about 40 μm (typical value), which is greater than the thickness of about 10 μm (typical value) of the other portions of the center electrodes 21. As a result, the center electrodes 21 are electrically connected with corresponding side electrodes 27 via a contact area that is at least 2 times greater than that according to the conventional technique.

Figure 8C:
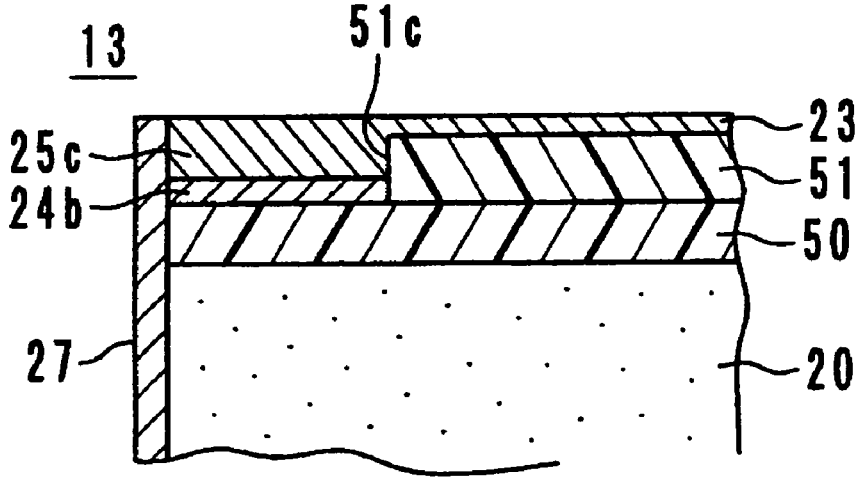

Further, both ends (for example, in areas represented by circles C in FIG. 7) of center electrodes 23 in the top layer (third layer) on the upper surface of the ferrite 20 are thickened by the filled-in electrodes 24*b* and 25*c* formed in the openings (recessed portions) 51*c* in the insulating film 51 on the lower surface of the center electrodes 23 in the top layer, as shown in FIG. 8C. That is, at both ends of the center electrodes 23, the thickness is increased downwardly to about 40 μm (typical value), which is greater than the thickness of about 10 μm (typical value) of the other portions of the center electrodes 23. As a result, the center electrodes 23 are electrically connected with corresponding side electrodes 27 via a contact area that is at least about 2 times greater than that according to the conventional technique.

Note that except for end portions, the thickness of each of the center electrodes 21 to 23 is similar to or the same as that of the conventional technique. Besides, because the thickness of each end of the center electrodes 23 in the top layer is increased downwardly, the increased thickness of end portions does not increase the total thickness of the center electrode assembly 13.

In the center electrode assembly 13, the center electrodes 21 to 23 and the insulating films 50 and 51 having complicated patterns on the ferrite 20 may be formed using the photosensitive thick film printing method that provides outstanding alignment accuracy among the different layers. Because layer-to-layer alignment is performed for the mother substrate, outstanding alignment accuracy is achieved regardless of the size of the center electrode assembly. Thus, in the method according to preferred embodiments of the present invention, unlike the conventional method in which the center electrode assembly is produced by winding a metal foil around ferrite, the center electrode assembly is easily produced even when the size of individual center electrode assemblies is reduced.

Thus, a center electrode assembly 13 having greatly improved connection reliability between the center electrodes 21 to 23 and the corresponding side electrodes 27 and having a reduced total thickness is produced.

Note that in this first preferred embodiment, since the insulating films 50 and 51 have the approximately the same size as that of the ferrite 20, the photosensitive thick film printing process is easily performed. Furthermore, because the side electrodes 27 are not bent at the edges of the ferrite, no mechanical stress is imposed on the side electrodes 27 at the edges of the ferrite. This further improves the reliability of the isolator 1. However, the insulating films 50 and 51 are not required to have the same size as the ferrite 20.

Figure 9:
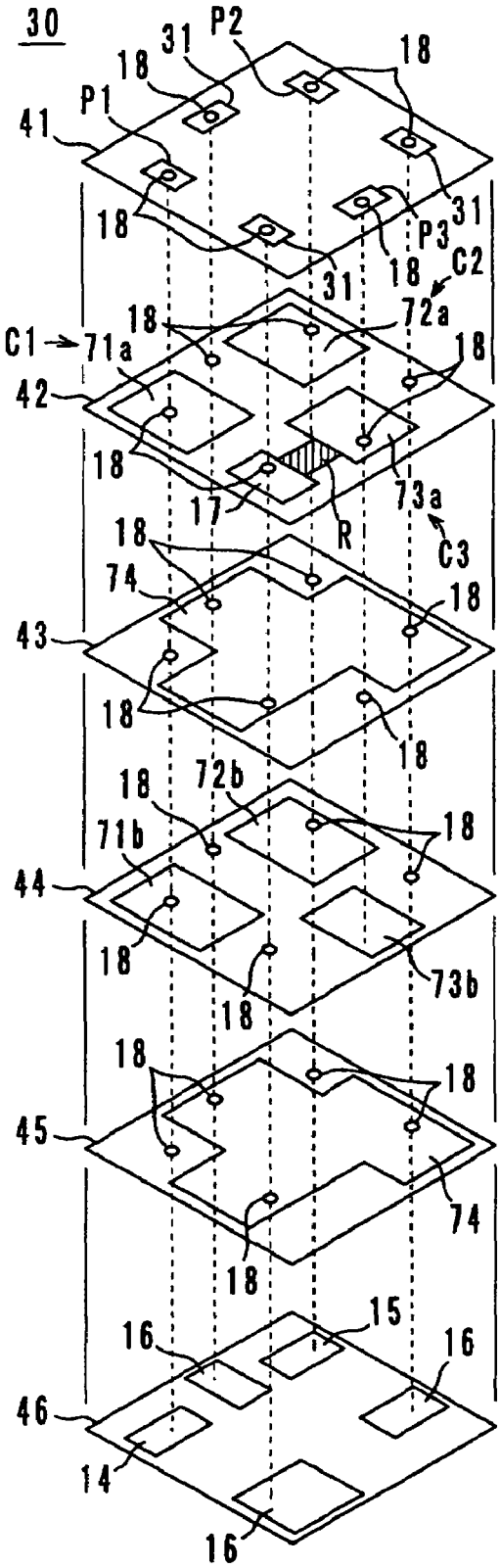
FIG. 9 is an exploded perspective view of a multilayer substrate shown in FIG. 1.

The multilayer substrate 30 includes, as shown in FIG. 9, a dielectric sheet 41 including center-electrode connection electrodes P1 to P3, a ground connection electrode 31, a via-hole 18, and a dielectric sheet 42 including hot-side capacitor electrodes 71*a* to 73*a*, a circuit electrode 17, and a terminating resistor R that are all provided on a surface of the dielectric sheet 42, a dielectric sheet 44 including hot-side capacitor electrodes 71*b* to 73*b*, dielectric sheets 43 and 45 each including a ground electrode 74, an input terminal electrode 14, an output terminal electrode 15, and a ground terminal electrode 16.

For example, the multilayer substrate 30 may be produced as follows. The dielectric sheets 41 to 45 are made of a low-temperature sintered dielectric material including $Al_2O_3$ as a major component and, as a minor component, one or more of $SiO_2$, SrO, CaO, PbO, $Na_2O$, $K_2O$, MgO, BaO, $CeO_2$, and $B_2O_3$.

A shrinkage prevention sheet 46 for preventing longitudinal shrinkage (in X-Y directions) of the multilayer substrate 30 during sintering of the multilayer substrate 30 is provided using a material that does not sinter at a temperature (lower than about 1000° C.) at which the multilayer substrate 30 is sintered. An example of the material for the shrinkage prevention sheet 46 is a mixture of alumina powder and stabilized zirconia powder. The thicknesses of sheets 41 to 46 are in the range of about 10 μm to about 200 μm, for example.

The electrodes P1 to P3, 14 to 17, 31, 71*a* to 73*a*, 71*b* to 73*b*, and 74 are formed on the sheets 41 to 46 by screen printing or another suitable method. Examples of materials of the electrodes P1 to P3, etc., are Ag, Cu, and Ag—Pd, each of which can be sintered at the same time as the dielectric sheets 41 to 45.

The terminating resistor R is formed on the surface of the dielectric sheet 42 by screen printing or another suitable method. Examples of materials for the resistor R are cermet, carbon, and ruthenium.

The via-holes 18 for signal transmission are formed by first forming holes in the dielectric sheets 41 to 45 by laser beam machining or punching, and then filling conductive paste in the holes. In general, the same material (Ag, Cu, Ag—Pd, or the like) as that used for the electrodes P1 to P3, is used for the conductive paste.

Matching capacitors C1, C2, and C3 are formed between the ground electrode 74 and capacitor electrodes 71*a*, 71*b*, 72*a*, 72*b*, 73*a* and 73*b*, wherein each matching capacitor includes dielectric sheets 42 to 44 disposed between the ground electrode 74 and the respective capacitor electrodes. An electric circuit is formed in the multilayer substrate 30 using the matching capacitors C1 to C3, the terminating resistor R, the electrodes P1 to P3, 17, and 31, and the signal via-holes 18.

The dielectric sheets 41 to 45 are disposed one on top of another to form a multilayer structure, and shrinkage prevention sheets 46 are disposed on the top and the bottom of the resultant multilayer structure (the shrinkage prevention sheets on the top is not shown in FIG. 9). Thereafter, the multilayer structure is sintered. After sintering, the non-sintered shrinkage prevention material is removed by ultrasonic cleaning or wet honing to thereby obtain a final multilayer substrate 30 as shown in FIG. 1.

In the multilayer substrate 30, the input terminal electrode 14, the output terminal electrode 15, and the ground terminal electrode 16 are provided on the lower surface of the multilayer substrate 30. The input terminal electrode 14 is electrically connected to the capacitor electrodes 71*a* and 71*b* via a signal via-hole 18, and the output terminal electrode 15 is electrically connected to the capacitor electrodes 72*a* and 72*b* via another signal via-hole 18. The ground terminal electrodes 16 are electrically connected to the circuit electrode 17 and the ground electrode 74. Thick-film electrodes in the shape of bumps are formed on the respective input and output terminals 14 and 15 by coating conductive paste of Ag, Ag—Pd, or Cu and baking it.

The components produced in the above-described manners are assembled as follows. As shown in FIG. 1, the permanent magnet 9 is bonded via an adhesive to the ceiling of the upper metal case 4. The center electrode assembly 13 is mounted on the multilayer substrate 30 and soldered such that one end of each of the center electrodes 21 to 23 is connected to the center-electrode connection electrode P1, P2, or P3 and the other end of each of the center electrodes 21 to 23 is connected to the ground connection electrode 31. Soldering to connect the center electrodes 21 to 23 to the connection electrodes P1, P2, P3, and 31 is performed in an efficient manner on the mother substrate which includes the multilayer substrates 30.

The multilayer substrate 30 is disposed on the bottom portion 8*a* of the lower metal case 8, and the ground terminal electrode 16 provided on a back surface of the sheet 45 is soldered to the bottom portion 8*a* to thereby fix the multilayer substrate 30 to the lower metal case 8 and electrically connecting the ground terminal electrode 16 to the lower metal case 8. This achieves a good ground connection and thus outstanding electrical characteristics of the isolator 1.

Figure 10:
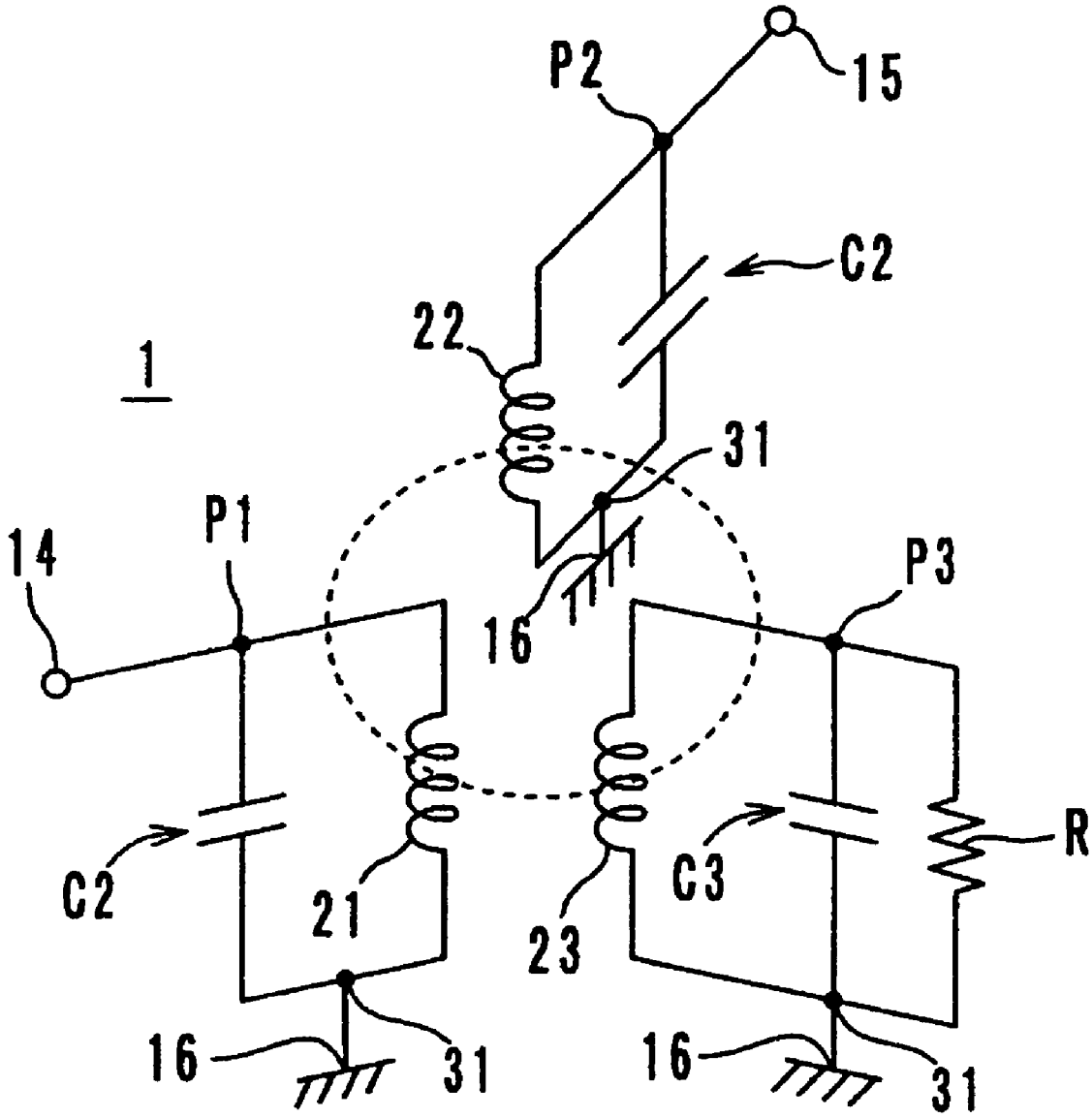
FIG. 10 is a circuit diagram showing an equivalent electrical circuit of the nonreciprocal circuit device shown in FIG. 1.

Thereafter, the side portions 8*b* of the lower metal case 8 and the side portions 4*b* of the upper metal case 4 are connected to each other by soldering so as to obtain a completed the metal case, which functions as a ground terminal, a yoke, and an electromagnetic shield. That is, the metal case forms a magnetic path surrounding the permanent magnet 9, the center electrode assembly 13, and the multilayer substrate 30. A constant magnetic field is applied to the ferrite 20 from the permanent magnet 9. FIG. 10 is an equivalent electrical circuit of the isolator 1.

Figure 11:
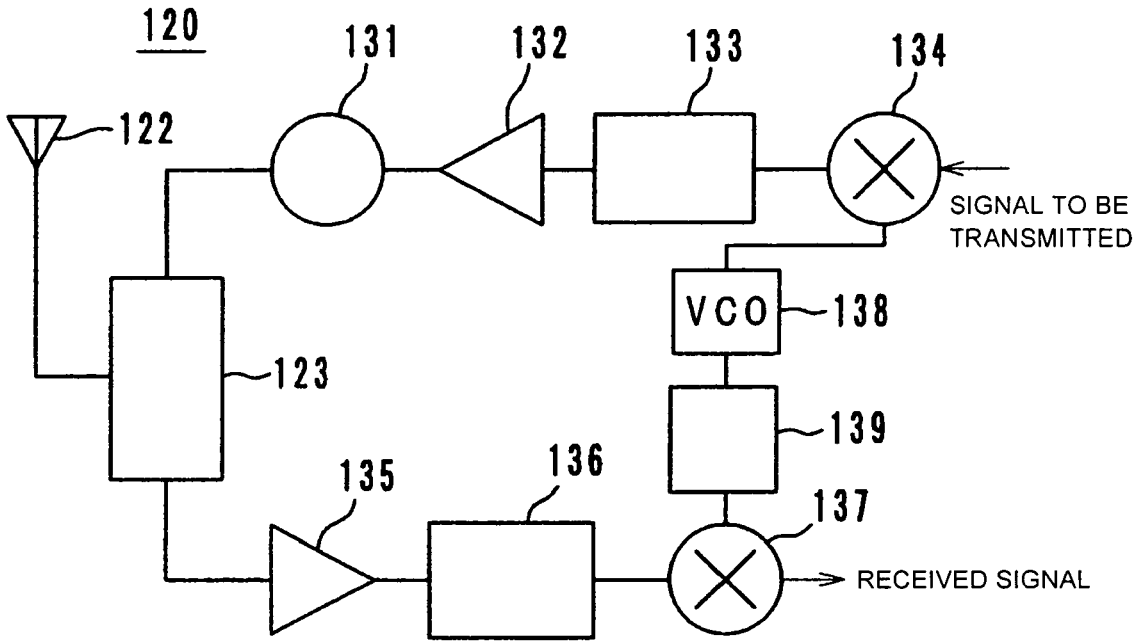
FIG. 11 is a block diagram showing a communication device according to another preferred embodiment of the present invention.
Figure 12:
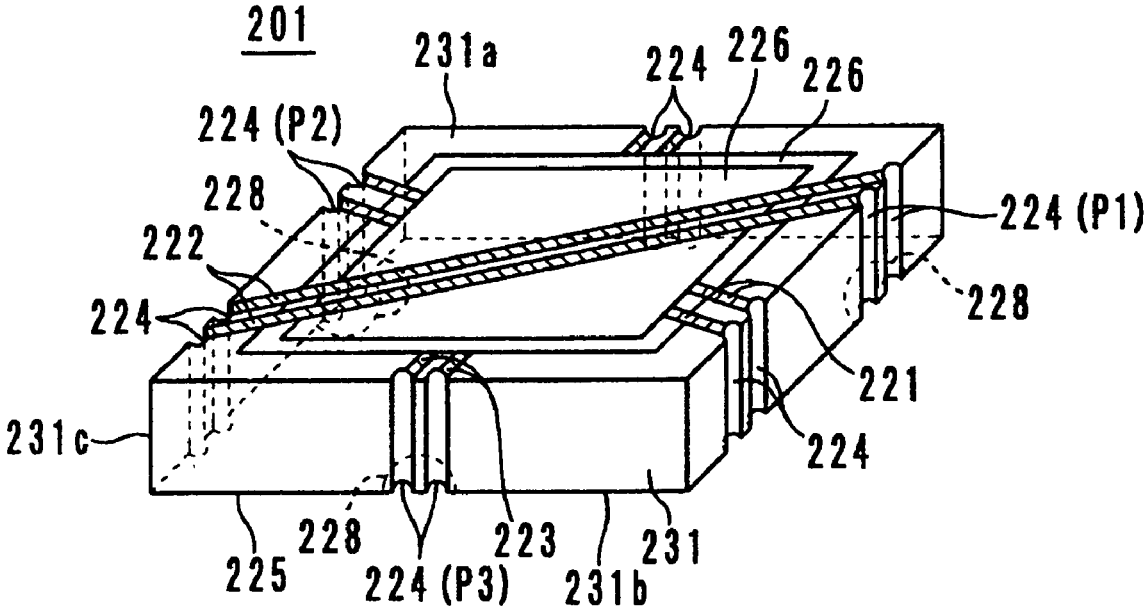
FIG. 12 PRIOR ART
FIG. 12 is a perspective view showing the external appearance of a center electrode assembly according to a conventional technique.
Figure 13:
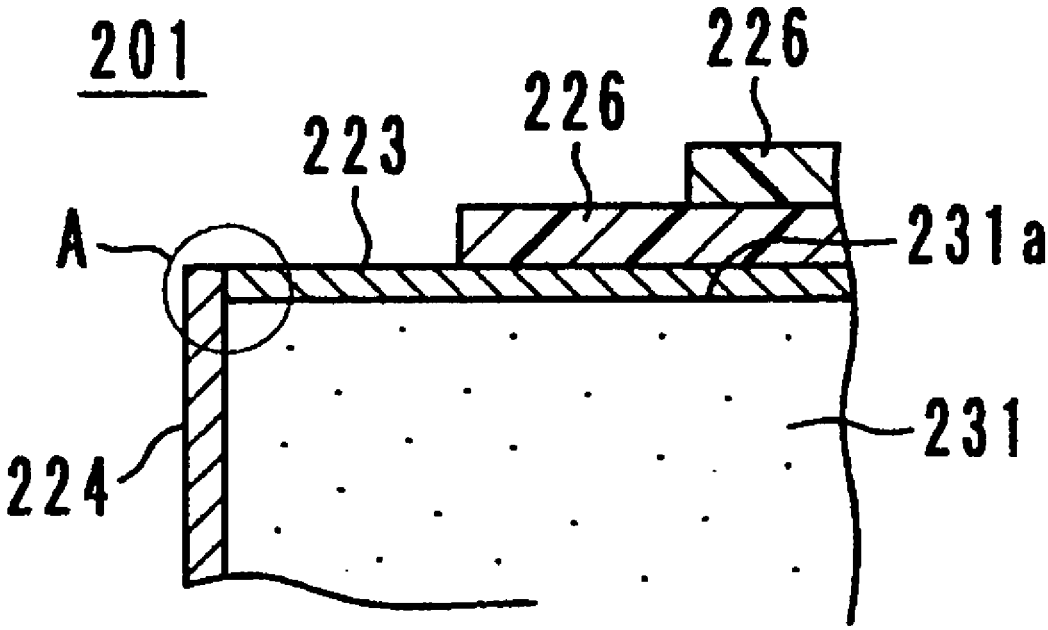
FIG. 13 PRIOR ART
FIG. 13 is a vertical cross-section view showing a connection between an end portion of a center electrode and a side electrode according to a conventional technique.

Second Preferred Embodiment (FIG. 11)

A preferred embodiment of a communication device according to the present invention is described below. In this specific preferred embodiment, by way of example, the communication device is a portable telephone.

FIG. 11 is a circuit block diagram of an RF section of a portable telephone 120. As shown in FIG. 11, the RF section of the portable telephone 120 includes an antenna 122, a duplexer 123, a transmitting isolator 131, a transmitting power amplifier 132, a transmitting interstage bandpass filter 133, a transmitting mixer 134, a receiving power amplifier 135, a receiving interstage bandpass filter 136, a receiving mixer 137, a voltage controlled oscillator (VCO) 138, and a local bandpass filter 139.

In this portable telephone 120, the lumped-constant isolator 1 according to the first preferred embodiment described above is provided as the transmitting isolator 131. Use of the isolator 1 produces a portable telephone 120 having greatly improved reliability.

Other Preferred Embodiments

The present invention is not limited to the specific preferred embodiments described above. On the contrary, various modifications are possible without departing from the spirit and the scope of the invention. For example, the nonreciprocal circuit device according to the present invention is not limited to the isolator, but the invention may also be applied to other types of nonreciprocal circuit devices such as a circulator or a coupler.

Furthermore, the structure is not limited to that shown in FIG. 8B or 8C, but rather, openings (recessed portions) may be formed in the insulating layer 50 at locations where end portions of center electrodes 21 or 23 are disposed. In this case, the thickness of end portions of the center electrodes 21 and 23 may be equal to the thickness of end portions of the center electrodes 22 shown in FIG. 8A.

Furthermore, the invention may be applied not only to a 3-port nonreciprocal circuit device but also a 2-port nonreciprocal circuit device. In the case of a 2-port nonreciprocal circuit device, the center electrodes in the second layer of the multilayer structure in the example described above become the center electrodes in the top layer. Thus, in this case, the end portions of the center electrodes in the second layer are thickened by forming filled-in electrodes in openings (recessed portions) in the insulating films on the lower surface of the end portions of the center electrodes in the second layer.

The present invention is not limited to each of the above-described preferred embodiments, and various modifications are possible within the range described in the claims. An embodiment obtained by appropriately combining technical features disclosed in each of the different preferred embodiments is included in the technical scope of the present invention.

What is claimed is:

1. A nonreciprocal circuit device comprising:

a center electrode assembly including a ferrite, a plurality of center electrodes and a plurality of insulating films defining a multilayer structure provided on a surface of the ferrite, and a plurality of side electrodes provided on side surfaces of the ferrite; wherein each end portion of each of the plurality of center electrodes provided on the surface of the ferrite has a thickness greater than the thickness of the other portions of each of the plurality of center electrodes, and each thicker end portion of each of the plurality of center electrodes is connected to a corresponding side electrode;

each thicker end portion of each of the plurality of center electrodes is made of a conductive material filled in a corresponding one of a plurality of openings provided in peripheral portions of the insulating films;

the thickness of each end portion of the center electrode in a bottom layer of the multilayer structure on the surface of the ferrite is increased by a conductive material filled in a corresponding one of the plurality of openings formed in the insulating films on an upper surface of the end portion; and the thickness of each end portion of the plurality of center electrodes in a top layer of the multilayer structure on the surface of the ferrite is increased by a conductive material filled in a corresponding one of the plurality of openings formed in the insulating films on a lower surface of the end portion.

2. A communication device including a nonreciprocal circuit device according to claim 1.

3. The nonreciprocal circuit device according to claim 1, wherein the ferrite is a microwave ferrite.

4. The nonreciprocal circuit device according to claim 1, wherein each of said plurality of center electrodes is made of a material selected from the group consisting of Ag, Cu and Ag—Pd.

5. The nonreciprocal circuit device according to claim 1, wherein the center electrodes are patterned using a photosensitive printing method.

6. The nonreciprocal circuit device according to claim 1, wherein the insulating films are patterned using a photosensitive printing method.

7. The nonreciprocal circuit device according to claim 1, further comprising a metal case including a lower metal case and an upper metal case, said lower metal case having a bottom portion and right and left side portions, and said upper case having a top portion and four side portions.

8. The nonreciprocal circuit device according to claim 1, wherein each of said thicker end portions has a thickness of about 40 μm.

9. The nonreciprocal circuit device according to claim 1, wherein said multilayer structure further comprises at least one shrinkage prevention sheet provided on at least one of an upper surface and a lower surface of the multilayer structure.

* * * * *